United States Patent [19]

Bowyer

[11] Patent Number: 4,460,040

[45] Date of Patent: Jul. 17, 1984

[54] EQUALIZING ANNULUS VALVE

[75] Inventor: Michael L. Bowyer, Aberdeen, Scotland

[73] Assignee: Baker Oil Tools, Inc., Orange, Calif.

[21] Appl. No.: 444,408

[22] Filed: Nov. 24, 1982

[51] Int. Cl.[3] ..... E21B 34/10

[52] U.S. Cl. ..... 166/129; 166/324

[58] Field of Search ..... 166/324, 129, 130, 183

[56] References Cited

U.S. PATENT DOCUMENTS 4,049,052 9/1977 Arendt ..... 166/183

4,271,903 6/1981 Slagle, Jr. ..... 166/183 X

*Primary Examiner*—James A. Leppink

*Assistant Examiner*—Timothy David Hovis

*Attorney, Agent, or Firm*—Norvell & Associates

[57] ABSTRACT

An equalizing annulus valve for use in controlling flow in the annulus between two tubular conduits in a subterranean oil or gas well has a control pressure responsive main valve piston and a booster piston for closing radial flow ports. The booster piston is spring loaded relative to the main piston and excess annulus pressure below the valve acts on the booster piston rather than on the main piston. The main piston can be partially opened before abutting the booster piston to permit pressure below the valve to meter through an equalizing port in the main piston and through the main flow ports. When the pressure is equalized, the main piston and booster piston can be shifted to a fully open position. An auxiliary piston responsive to an increase in annulus pressure can also be used to shift the main piston.

15 Claims, 7 Drawing Figures

EQUALIZING ANNULUS VALVE

BACKGROUND OF THE INVENTION

1. Field of the Invention

This invention relates to a valve for controlling flow in the annulus between an inner fluid transmission conduit and an outer fluid transmission conduit in a subterranean oil or gas well, and more specifically to an annulus control valve having means for equalizing pressure above and below the valve element prior to establishing full flow through the valve.

2. Description of the Prior Art

In subterranean oil and gas well completions a production tubing string is generally employed concentrically within the outer casing of the well. This inner production tubing string serves as a first fluid transmission conduit. Quite often the production tubing string is employed in conjunction with a downhole packer which serves to isolate the annular area between the tubing and casing above the packer from the annular area below the packer. In addition safety valves are often employed to shut-in the primary production tubing string in an emergency. Quite often it is necessary to provide for flow not only in the primary production tubing string but also in a secondary fluid transmission conduit, such as that defined by the annulus between the tubing string and the casing. For example, fluids from one producing zone might be produced through the tubing string while gases produced in a separate zone might be produced through the annulus. In other situations it might be necessary to inject a corrosion inhibitor through the annulus while produced fluids are transported from the formation to the surface through the primary production tubing string. Another example is the situation in which a gas might be injected through the tubing string to provide gas lift for the production of fluids through the annulus.

When the annulus is used as a fluid transmission conduit it is necessary to provide some means of controlling the flow through the annulus. Generally, an annulus safety valve will be utilized to prevent uncontrolled flow through and annulus in the event of an emergency. A conventional annulus safety valve is disclosed in U.S. patent application Ser. No. 307,820 filed on Oct. 2, 1981. Conventional annulus type safety valves employ a means of sealing the annulus at a specific location. Conventional packing elements or seals are generally employed between the exterior and interior tubular members to close off the annulus. On either side of the packing or sealing member a bypass flow port permits flow from the annulus through the port and through an axially extending bypass conduit extending around the packing or sealing member. The flow port on the opposite end of the packing or sealing member then permits flow back into the annulus on the opposite side of the packing or sealing member. A conventional annulus control valve employs an axially movable piston for opening and closing at least one of the bypass flow ports or for opening and closing the bypass conduit between the flow ports.

These conventional non-equalizing annulus safety valves perform most satisfactorily in the absence of a substantial pressure differential when the valve is closed. In the presence of a substantial pressure differential which can arise when the annulus valve is closed, the rapid flow through the flow port when the valve is initially opened can be quite damaging to the valve and to the tubing string or casing. This same problem exists with conventional tubing safety valves. This problem can be avoided with conventional tubing safety valves by providing for some means to equalize the pressure before the valve is fully open. For example the valve in U.S. Pat. No. 3,796,257 has an equalizing mechanism for permitting equalizing flow around the primary flow closure member of the tubing mounted safety valve to equalize pressure in the tubing above and below the valve. Tubing safety valves lend themselves to a variety of different means for providing equalization of pressure above and below a closed flow closure member.

The preferred embodiment of the invention disclosed herein provides a means for equalizing the flow above and below an initially closed annulus control or safety valve by providing for initial equalizing flow through a partially open annulus safety valve. Use of the equalizing annulus safety valve permits pressure equalization in those instances where the annulus above the valve cannot be pressurized to equalize any pressure differential that may exist as a result of the build-up of a high pressure below a closed flow port prior to opening the valve. It will of course be understood that this invention is not limited in application to those situations in which the excess pressure exists below the flow port. The preferred embodiment of this invention could also be adapted to the situation in which the pressure in the annulus above the flow port would be greater than the pressure in the annulus below a closed flow port.

SUMMARY OF THE INVENTION

An equalizing annulus valve for controlling the flow in the annulus between an inner conduit or tubing string and an outer conduit, such as a subterranean well casing can be employed as an annulus safety valve or as a flow control valve. The valve housing has one or more radial flow ports positionable above an apparatus such as a packer or packoff hanger having packing or sealing elements for closing the annulus at some axial location. A main valve piston closing at least one of the flow ports is axially movable in response to an increase in hydraulic control pressure in a separate control line. Annulus pressure above the valve acts on opposite surfaces of the pressure balanced main piston. A separate booster piston is shiftable relative to the main piston. Pressure below the valve acts on one surface of the booster piston and pressure below the valve acts on the opposite surface. In the presence of greater pressure below the valve than above the valve, the booster piston is axially shifted relative to the valve housing and the main piston. When control pressure is increased, the main piston, upon which no substantial pressure force acts as a result of increased pressure below the valve, can axially shift only a limited amount before abutting the booster piston. Initial movement of the main piston is sufficient to permit metered equalizing flow communication through the main flow ports between the annulus above and below the valve. When pressure is equalized, the main piston and booster piston can be shifted to fully open the flow port. Alternatively the main piston may be shifted by an increase in annulus pressure above the valve. Increased upper annulus pressure does not establish a resultant pressure force acting directly upon the main piston. An auxiliary piston is however shifted by an increase in pressure force above the valve. This auxiliary piston abuts and axially shifts the main piston to open the valve.

DESCRIPTION OF THE PREFERRED EMBODIMENT

Figure 1A:
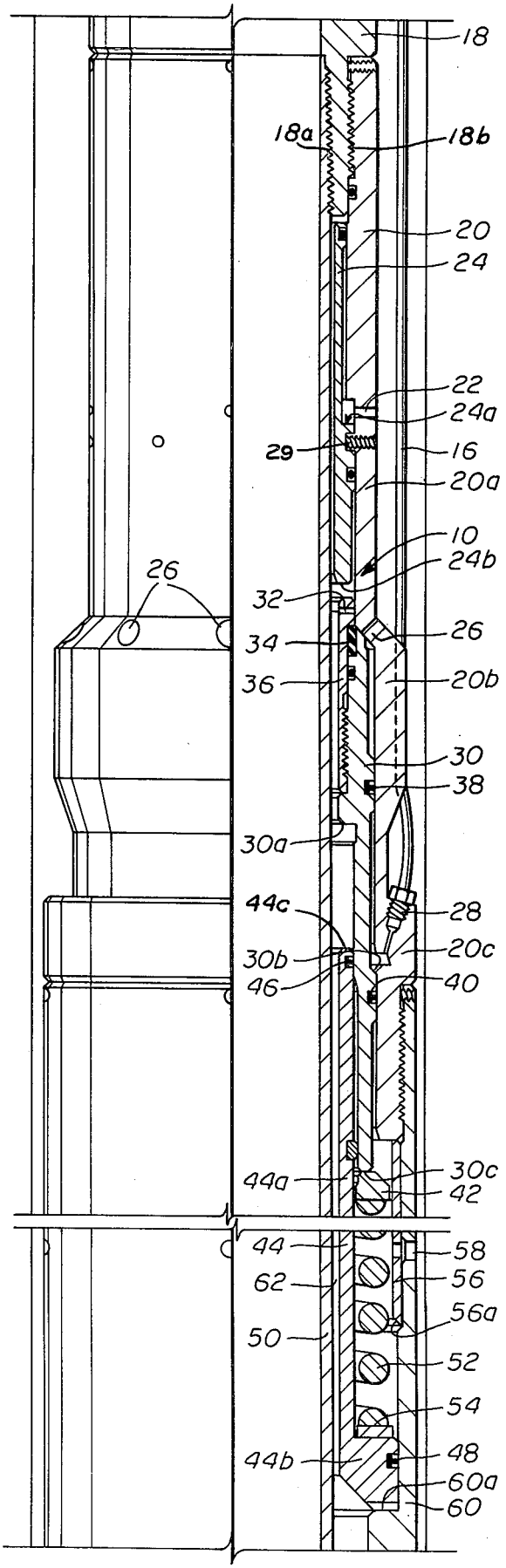
FIGS. 1A through 1C comprise longitudinal continuations showing an equalizing annulus safety valve in the closed position, in which a packer is used to seal the annulus between upper and lower flow ports.
Figure 1B:
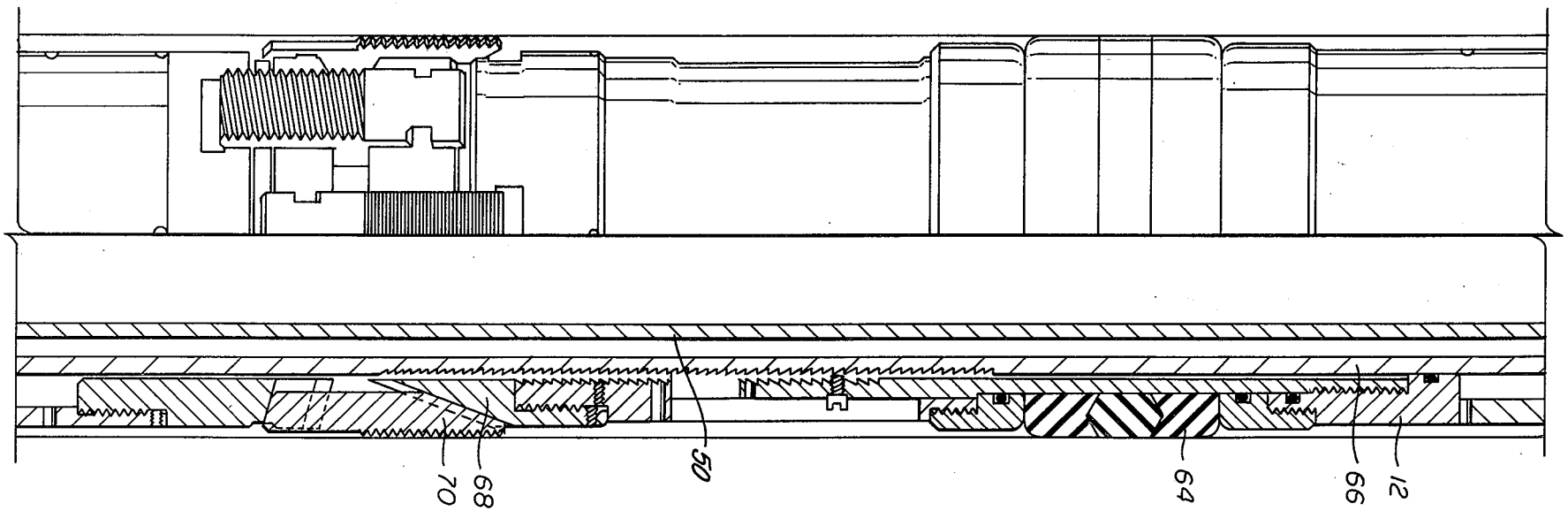
Figure 1C:
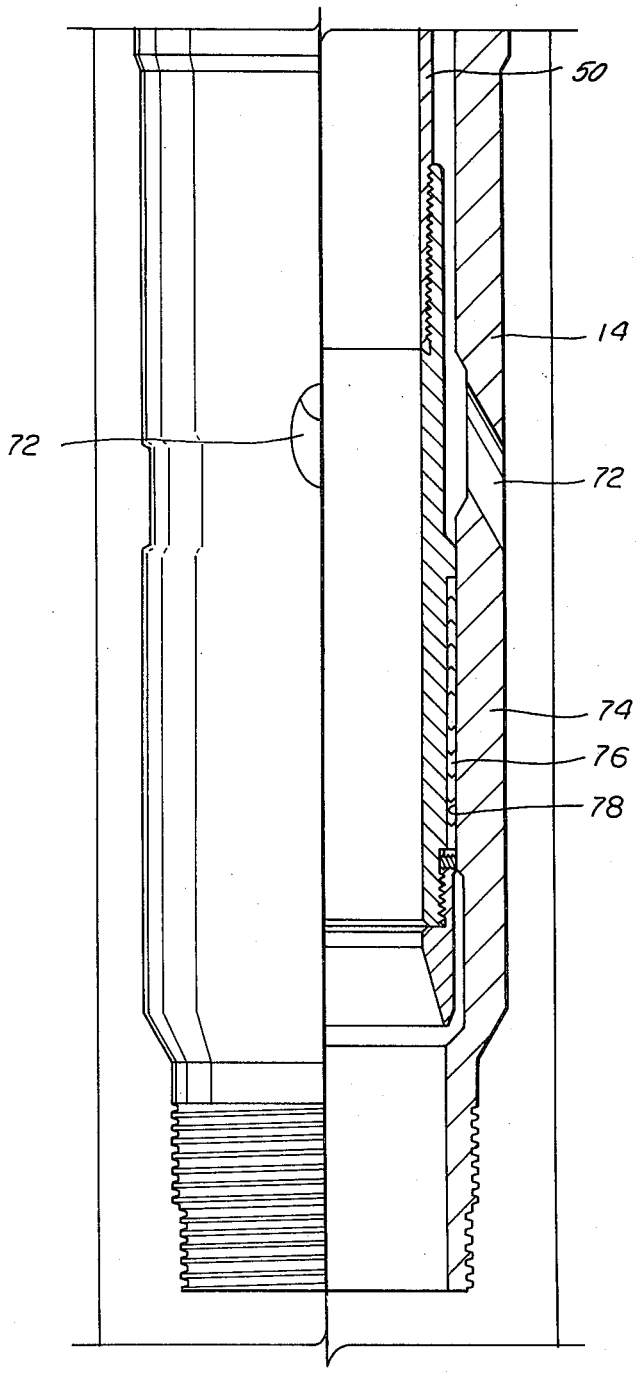

The preferred embodiment of this invention comprises an equalizing annulus safety valve which can be mounted by conventional means into a packer or packoff tubing hanger located below the valve. FIGS. 1A–1C are longitudinal continuations of an annulus safety valve and packoff tubing hanger assembly. The valve 10 is mounted in packoff tubing hanger 12 which in turn has a ported bottom sub 74 extending therebelow. In use, valve 10 is attached at its upper end to the lower end of a tubing string (not shown). On the lower end of the valve is a conventional anchor latch assembly (also not shown) for engaging the upper end of the packoff hanger 12. An inner tubular member 50 extends from valve 10 through the packoff tubing hanger 12 and has a conventional seal stack 76 at its lower end for engaging a suitable surface 78 below valve port 72 located on the lower ported sub attached to the lower end of packoff tubing hanger 12.

The equalizing annulus safety valve 10 is shown in the closed position in FIG. 1A. The upper end of the valve 10 comprises a main outer housing member 20 attached to a top sub member 18 having threads **18*a* and 18*b* along its inner and outer surface. The upper end of the inner mandrel 50 is also attached to the threaded connection 18*a* on top sub member 18. The upper end of top sub member 18 comprises a conventional box type connection (not shown) for engaging the tubing member extending above the valve. Main valve housing member 20 comprises an upper section 20*a*, a medial section 20*b* having a diameter larger than the diameter of the upper section 20*a* and a lower section 20*c* having an inner and outer diameter substantially the same as the inner and outer diameter of medial section 20*b*. A radially extending port 22 extends through the upper housing section 20*a* and provides communication with the annulus between the exterior of valve housing 20 and the casing or outer tubular member within which the safety valve is inserted. A cylindrical sleeve auxiliary piston 24 is attached to the inner bore of housing section 20*a* by means of a shear pin 29 extending through the housing. Conventional sealing means are positioned between the auxiliary piston 24 and the inner surface of upper housing section 20*a* both above and below port 22. Auxiliary piston 24 is thus carried in the annular cavity between inner tubular mandrel 50 and the upper housing section 20*a*. An exterior upwardly facing shoulder 24*a* marks the division between a narrow upper section on auxiliary piston 24 and an enlarged lower section extending therebelow. Shoulder 24*a* is located immediately below port 22 and above shear pin 29** in the shear pinned configuration of FIG. 1A.

Medial valve housing section **20*b* has an inner and outer diameter, both greater than the respective inner and outer diameters of upper housing section 20*a*. A plurality of radially extending flow ports 26 extend through the angled portion of the valve housing joining upper housing section 20*a* and medial housing section 20*b*. The outer diameter of medial housing section 20*b* has a reduced section below the flow ports 26 and immediately above the lower section 20*c* of the housing. A conventional hydraulic control line interconnection 28 is provided adjacent the upper end of the lower valve housing member 20*c*. A conventional control line 16 extends from the surface of the well through the annulus between the inner tubular member and the outer conduit or casing. Interconnection between control line 16 and the valve housing at 28** is by conventional means.

A first main axially reciprocal piston 30 is located on the interior of the main valve housing 20 adjacent medial housing section **20*b* and lower housing section 20*c*. A supplemental piston extension 36 is threadably attached to the inner surface of main piston 30 adjacent its upper end and extends beyond the upper end of the main section of piston 30. This upward extension of supplementary section 36 has an outer diameter generally equivalent to the inner diameter of the upper housing section 20*a*, and in the position shown in FIG. 1A, extends upwardly beyond the flow ports 26. A radially extending equalizing port 32 extends through the extension of section 36 above the upper end of the principal section of piston 30. A resilient seal 34 is positioned between the supplemental piston extension 36 in the main section of piston 30 and extends around the inner supplemental extension 36. Seal 34 is positioned to engage the inner bore of valve housing 20 above flow ports 26 when piston 30 is in the closed position. A conventional resilient seal 38 is positioned along the exterior of main piston 30 at a position below flow ports 26. Seal 38 engages the seal bore surface along the medial section 20*b* and portions of the lower section 20*c* of valve housing 20. Seal 34 and 40 engage the inner surface of valve housing 20 on opposite sides of ports 26 when main piston 30 is in the closed position to effectively seal and prevent flow through flow ports 26. A downwardly facing internal surface 30*a* is positioned along the interior of main piston 30 below supplemental piston 36 and defines the separation between portions of main piston 30 having a smaller bore above shoulder 30*a* than the remaining portions of piston 30 below external shoulder 30*a*. A separate upwardly facing shoulder 30*b* is located on the exterior of main piston 30 below shoulder 30*a*. A seal 40 located below external shoulder 30*b* engages the inner seal bore surface along the lower housing portion 20*c* below control line connection 28. Shoulder 30*b* is positioned between seal 38 above the control line interconnection and seal 40 below the control line interconnection thus defining an annular pressure cavity between piston 30 and housing 20*c* between seals 38 and 40**.

A lower valve housing 60 is threadably attached to upper valve housing 20 and has an inner diameter greater than the inner diameter of the lower section **20*c*** of upper housing 20. A second or booster piston 44 is located below main piston 30 and is positioned within lower housing 60. Booster piston 44 comprises a lower section **44*b* having a substantially larger diameter than the upwardly extending section 44*a*, the inner surface of which defines the inner bore of annular booster piston 44. Booster piston section 44 extends within and upwardly beyond the lower end 30*c* of main piston 30. A seal 46 positioned along the outer bore of upper booster piston section 44*a* engages an inner seal bore surface on piston 30 below shoulder 30*a*. In the preferred embodiment of this invention the diameter of the inner bore of upper booster piston section 44*a* is substantially equivalent to the diameter of the inner bore of main piston 30 immediately above shoulder 30*a*. The upwardly facing end 44*c* of booster piston section 44*a* is juxtapositioned and spaced from the downwardly facing main piston shoulder 30*a*. The outer diameter of booster piston section 44*a* is substantially smaller than the inner diameter of the lower cylindrical housing 60 and a spring retaining cavity is defined between booster piston section 44*a* and main housing 60. The lower end 30*c* of main piston 30 extends between housing section 60 and booster piston section 44*a* into this spring retaining cavity. A cylindrical sleeve 56 is located aong the inner surface of lower cylindrical housing 60 and is positioned in abutting relationship to the bottom end of lower main housing section 20*c*. A beveled interior surface is located at the lower end of sleeve 56 where sleeve 56 is positioned in abutting relationship with an upwardly facing shoulder on lower housing 60. The inner diameter of sleeve 56 is less than the inner diameter of housing section 60 within the spring cavity. A conventional helical spring 52 is positioned within the spring cavity between upper spring bushing 42 and lower spring bushing 54. Upper spring bushing 42 is reciprocal relative to sleeve 56 and booster piston section 44*a* and abuts the lower end 30*c* of main piston 30. Bushing 54 abuts the upwardly facing surface of the lower enlarged booster piston section 44*b*. Spring 52 is thus trapped between the lower end 30*c* of main piston 30 and the lower section 44*b* of the booster piston. Main piston 30 is reciprocal and is spring biased relative to booster piston 44 and booster piston 44 can thus telescope within main piston 30. An upwardly facing surface 60*a* located on the interior of lower housing section 60 defines the lowermost extent of the travel of booster piston 44. In FIG. 1A the lower end of booster piston 44*b* is in abutting relationship with upwardly facing surface 60*a* at the lowermost extent of the travel of booster piston 44. Since main piston 30 is at the uppermost extent of its travel the separation between main piston 30 and booster piston 44 is the greatest in the configuration of FIG. 1A**.

Figure 4:
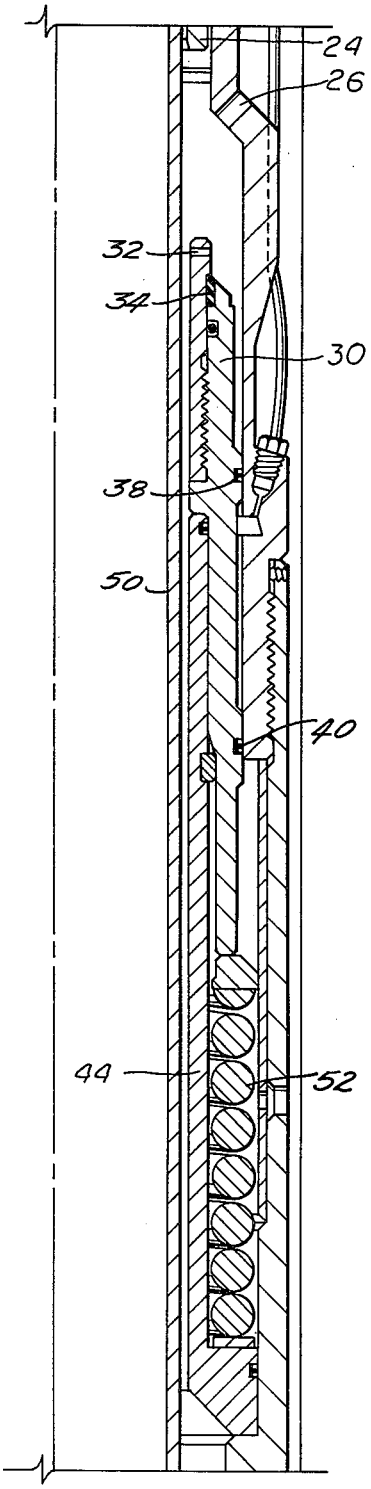
FIG. 4 is similar to FIG. 3 but shows the main valve member in its fully open position after pressure has been equalized to permit full flow through the upper and lower flow port.

Lower valve housing 60 is attached by conventional means to a conventional anchor seal assembly (not shown) which is used for engagement with the upper end of tubing hanger 12. Inner mandrel 50 extends inwardly through lower valve housing 60 and through the packoff tubing hanger 12 to define an axial bypass flow passage from the flow ports 26, when such ports are open (FIG. 4), through the valve housing and through packoff tubing hanger 12 to ported bottom sub 74. Flow can proceed through the packoff tubing hanger 12 and through valve 10 in the manner indicated by arrows in the subsequent drawings.

The packoff tubing hanger shown in FIG. 1B, through which inner mandrel 50 extends, generally comprises an inner body 66 surrounded by a resilient packing element 64 engaging the outer conduit wall. This conventional packoff tubing hanger employs a conventional anchoring arrangement comprising slips 70 engaging slip cones 68. Note that body 66 on packoff tubing hanger 12 is spaced from inner mandrel 50 to permit flow between the body of the packoff tubing hanger and mandrel 50. A lower ported sub 74 is attached by conventional means (not shown) to the lower end of packoff tubing hanger 12. Ported sub 74 has radially extending flow ports 72 extending through the main body section 14. As discussed previously seals 76 located on the lower end of mandrel 50 engage the inner seal bore on ported bottom sub 74. A continuous bypass passageway is thus defined through the annulus between the inner mandrel 50 and the outer conduit below the packoff tubing member upwardly between the body 66 of packoff tubing member 12 and mandrel 50 and between inner mandrel 50 and valve outer housings 20 and 60. This flow passageway is blocked by means of main piston member 30 in b configuration of FIG. 1A.

OPERATION

Figure 2:
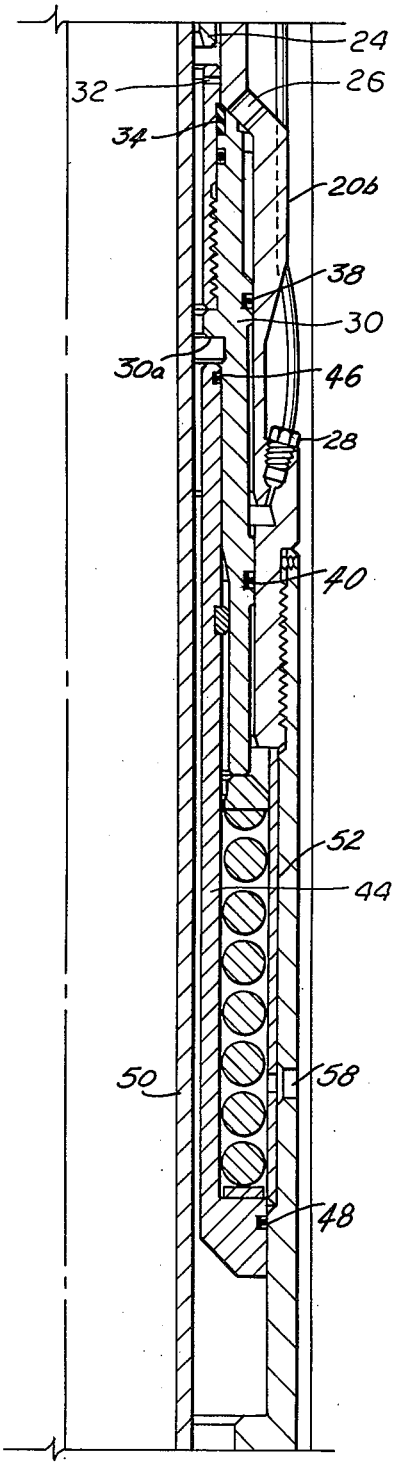
FIG. 2 shows the valve element of FIG. 1A under the influence of a larger pressure below the closed flow port than would exist above the flow port.

The position of the valve shown in FIG. 1A represents the position of the components when the valve closes flow ports 26 and when the pressure in the annulus below communicating with the interior of the valve housing is substantially equal to the pressure in the annulus above flow ports 26. FIG. 2 shows the valve still in the closed position but with the booster piston 44 shifted upward under the influence of an annulus pressure below the valve greater than the annulus pressure above the valve. The pressure on the lower surface of booster piston 44 is equal to the annulus pressure below the valve while the pressure in the cavity containing spring 52 is equal to the pressure in the annulus above the valve. Radially extending port 58 extending through housing 60 provides communication between the annulus above the valve and the cavity between booster piston section **44*a* and lower housing section 60. Seal 48 engages the inner surface of housing 60 and the pressure differential existing across seal 48 is equal to the difference between the annulus pressure below the valve and the annulus pressure above the valve. The difference in the diameter between seal 48 and seal 46 insures that the pressure in the annulus below the valve will act on a substantially large area of booster piston 44 to urge the booster piston upward. The upward travel of booster piston 44 is limited by engagement of the upper shoulder of booster piston section 44*b* with the downwardly facing surface of sleeve 56. Annulus pressure below the valve will force booster piston 44 upwardly until engagement between sleeve 56 and lower piston section 44*b* prevents further upward movement of booster piston 44. Note that the upper end 44*c* of booster piston 44 is spaced from the downwardly facing surface 30*a* at the uppermost extend of the travel of booster piston 44. When the piston 44 is subjected to pressure from below to move piston 44 to the uppermost extent of its travel, forces transmitted through spring 52 to main piston 30 act to insure that the main piston will remain closed in the presence of substantial pressure below the valve. Thus valve 10** can serve as a safety valve in the event of an emergency in which the annulus pressure above the valve may be substantially less than the annulus pressure below the valve.

Figure 3:
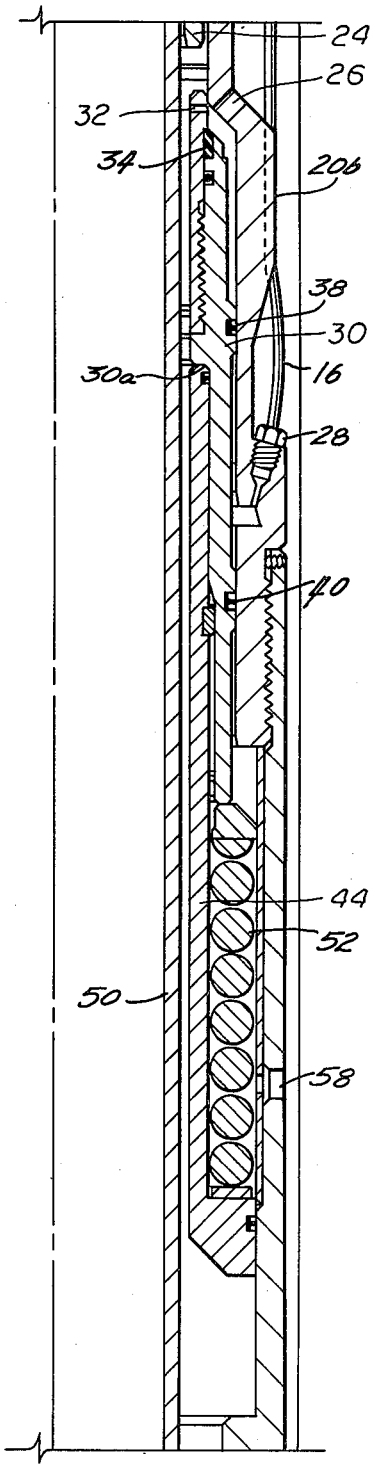
FIG. 3 is similar to FIG. 2 but shows the equalizing configuration of the annulus safety valve.
Figure 5:
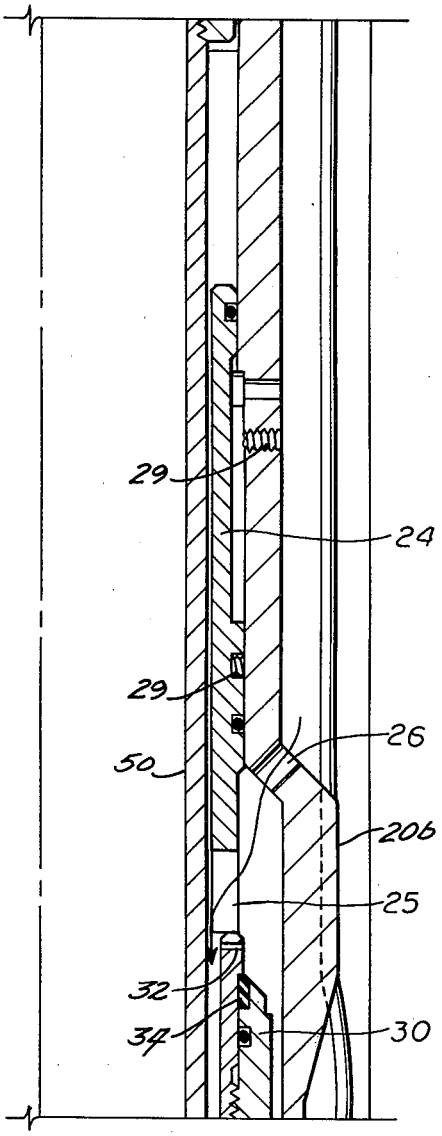
FIG. 5 shows an auxiliary piston responsive to annulus pressure to open the main piston and permit flow through the upper port to substantially the same degree as that shown in FIG. 4, where annulus pressure above the valve has been increased to actuate the auxiliary piston.

In the configuration of FIG. 2 the main piston 30 is substantially unaffected by the direct application of the annulus pressure below the valve on the piston itself. In configuration of FIG. 2 only the force exerted by spring 52, which of course is at least in part as a result of the upward movement of piston 44 as a result of pressure below the valve is exerted upon piston 30. The pressure within the cavity occupied by spring 56 is equal to the pressure in the annulus above the valve. Thus the annulus pressure acting on the upper surface of the valve is equal to the annulus pressure acting on substantially the entire portion of the lower surface of the valve and since the upper and lower areas are substantially equal the resultant pressure acting on the main piston member 30 is balanced. The load of spring 52 is the primary force holding piston 30 in the closed position. To open the valve main piston 30 is moved downwardly in response to application of increased hydraulic control fluid pressure through control line 16 acting on the exterior of piston 30 between seals 38 and 40. Increased control fluid pressure will cause main piston member 30 to move downward toward booster piston 44. FIG 3 shows the initial movement of main piston 44 under the influence of increased hydraulic control pressure. Note that the initial movement of piston 30 is limited because downwardly facing shoulder 30*a* comes into abutment with the upward end of booster piston 44. Abutment between these two shoulders prevents further movement of piston 30 downward and an additional force acts upon main piston 30 equal to the annulus pressure load acting to keep the booster piston 44 in the position of FIGS. 2 and 3. Movement of main piston 30 to the position of FIG. 3 has however provided communication through equalization port 32 and through main flow ports 26 between the annulus above the valve and the annulus below the valve. Thus after the valve has been moved to the position of FIG. 3 the pressure differential resulting from the greater pressure below the valve than in the annulus above the valve can be equalized through port 32 and through the main flow ports 26. When this pressure load has been equalized both the main piston 30 and the booster piston 44 can be moved from the position of FIG. 3 to the position in FIG. 4 in which both the main piston 30 and the booster piston 44 are at the lowermost extent of their travel. Flow ports 26 are then fully open. The flow port can then be maintained in its fully open position with flow upwardly through the passage between mandrel 50 and the outer valve housing and packoff tubing hanger through flow ports 26 by the application of a control pressure through control line 16 which will counterbalance the force exerted by spring 52 in the position of FIG. 4. Main piston 30 can be returned to the closed position of FIG. 1A by reducing the control pressure force acting on piston 30 to permit spring 52 to move the piston to its upward closed position. The arrows in FIG. 5 represent the flow through the valve 10 and ports 26. Note that flow in the upward direction extends from the annulus between the tubing below the valve and the outer conduit as it passes through flow port 72 and along the axial passageway on the exterior of tubular member 50.

In addition to opening the main piston 30 by application of control pressure through control line 16, this valve can be opened by an increase in pressure in the annulus above the valve. Increased annulus pressure above the valve does not act directly upon piston 30 to cause the piston to open because pressure in the annulus above the valve acts on oppositely facing surfaces of piston 30 which are of substantially equal area, thus maintaining the pressure balance acting directly upon valve member 30. Increased annulus pressure above the valve will however act through port 22 upon auxiliary piston 24. When the annulus pressure force acting upon auxiliary piston 24 exceeds the strength of shear pin 29 the auxiliary piston 24 can be separated from upper valve housing 20 to move downwardly into engagement with the upper end of main piston 30. At this point the pressure force acting upon the auxiliary piston 28 is not balanced by an equal pressure force acting upwardly on main piston 30. When the pressure force acting on auxiliary piston 24 exceeds the upward force exerted by spring 52, the main piston 30 will be urged downwardly into the open position. When the main valve member 30 is in the downward position kill fluid can be circulated through ports 26. Annulus pressure actuated auxiliary piston 24 also permits an operator to determine the annulus pressure below the valve member. The auxiliary piston 24 also provides a means for opening the valve in the event that the control line 16 inadvertently become plugged or inoperable. Thus the valve may be opened both by an increase in annulus pressure and by an increase in hydraulic control pressure.

Although the invention has been described in terms of the specified embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A valve for controlling the flow around a seal element disposed in the annulus between a first tubular conduit and a second conduit receiving the first conduit, comprising:

a valve housing defining a bypass around said seal element;

radially extending flow port means in the housing and at one end of said bypass passage;

a first axially shiftable piston movable from a position closing the flow port means to a position opening the flow port means;

a second piston axially shiftable relative to the first piston and the valve housing to an upper position when the annulus pressure below said seal element exceeds the annulus pressure above said seal element;

abutting means on the second piston for limiting downward travel of the first piston when the annulus pressure below said seal element exceeds the annulus pressure above said seal element; and equalizing means in the first piston for annulus pressure equalization through the flow port means and bypass passage when downward travel of the first piston is limited by the second piston.

2. The valve of claim 1 wherein the equalizing means comprises a radially extending port through the first piston.

3. The valve of claim 1 further comprising biasing means between the first and second piston members opposing downward movement of said first piston.

4. The valve of claim 3 wherein the biasing means comprises a spring.

5. The valve of claim 1 further comprising means for limiting the travel of the first piston member in the upward direction, the second piston member being shiftable from the closed position toward the open position when the second piston member is at the uppermost extent of its travel.

6. The valve of claim 5 further comprising means on the second piston member for preventing movement of the first piston member to the fully open position when the second piston is at the uppermost extent of its travel, with said equalizing means allowing annulus pressure equalization when the second piston member is at the uppermost extent of its travel.

7. The valve of claim 5 further comprising means for shifting said first and second piston members to the first piston member open position after the annulus pressure below said seal element equals the annulus pressure above said seal element.

8. A valve for controlling the flow around a seal element in the annulus between a first tubular conduit and a second conduit receiving the first conduit, comprising:

an annular housing incorporable within the inner tubular fluid transmission conduit and defining a bypass passage around said seal element;

radially extending flow port means in the housing communicating between said annulus and said bypass passage;

a first axially shiftable piston member, mounted in said housing and movable in response to control pressure from a position closing the flow port means, the first piston member having an upper surface exposed to the annulus pressure above said seal element in the closed position and a smaller lower surface exposed to annulus pressure below said seal element;

means for supplying control pressure to shift the first piston member;

a second piston member axially movable relative to the first piston member and having an upper surface expposed to pressure above said seal element and a lower surface exposed to pressure below said seal element; and an equalizing opening in the first piston member allowing annulus pressure equalization through said flow port and bypass passage after initial movement of the first piston member from the closed position.

9. The valve of claim 8 further comprising biasing means between the first and second piston members opposing movement of said first piston from said flow closing position.

10. The valve of claim 9 wherein the biasing means comprises a spring.

11. The valve of claim 9 further comprising means for limiting the travel of the second piston member in the upward direction, said first piston member being shiftable from the closed position toward the open position when the second piston member is at the uppermost extent of its travel.

12. The valve of claim 11 further comprising means on the second piston member for preventing movement of the first piston member to the fully open position when the second piston is at the uppermost extent of its travel, with said equalizing opening allowing pressure equalization when the second piston member is at the uppermost extent of its travel.

13. The valve of claim 11 further comprising means for shifting said first and second piston members to the first piston member open position after the annulus pressure below said seal element equals the annulus pressure above said seal element.

14. A valve for controlling the flow around a seal element disposed in the annulus between a first tubular conduit and a second conduit receiving the first conduit, comprising:

a valve housing incorporable in said first conduit and defining a bypass passage around said seal element;

radially extending flow port means the housing and in in one end of said bypass passage;

a first axially shiftable piston movable from a position closing the flow port means to a position opening the flow port means;

means for communicating control pressure in a separate control line to shift the first piston member;

a second piston axially shiftable relative to the first piston and the valve housing to an upper position when said seal element exceeds the annulus pressure above said seal element;

abutting means on the second piston for limiting downward travel of the first piston when the annulus pressure below said seal element exceeds the annulus pressure above said seal element;

equalizing means in the first piston for annulus pressure equalization through the flow port means when downward travel of the first piston is limited by the second piston; and a third piston axially shiftable upon an increase in annulus pressure above said seal element into engagement with the first piston to move the first piston downward to open the flow port means.

15. The valve of claim 14 wherein a radially extending port extends through said first piston to provide fluid communicatlion through the flow port means and through said first piston port when said first piston is initially urged downward.

* * * * *